US011493049B2

(12) United States Patent
Tiller

(10) Patent No.: US 11,493,049 B2
(45) Date of Patent: Nov. 8, 2022

(54) TORQUE-THRUST CHAMBER FOR HORIZONTAL PUMP TEST SYSTEMS

(71) Applicant: Baker Hughes, LLC, Houston, TX (US)

(72) Inventor: Jeff Tiller, Claremore, OK (US)

(73) Assignee: Baker Hughes Holdings LLC, Houston, TX (US)

( * ) Notice: Subject to any disclaimer, the term of this patent is extended or adjusted under 35 U.S.C. 154(b) by 238 days.

(21) Appl. No.: 16/570,833

(22) Filed: Sep. 13, 2019

(65) Prior Publication Data

US 2020/0088200 A1 Mar. 19, 2020

Related U.S. Application Data

(60) Provisional application No. 62/733,196, filed on Sep. 19, 2018.

(51) Int. Cl.

| | |
|---|---|
| ***F04D 1/06*** | (2006.01) |
| ***F04D 29/043*** | (2006.01) |
| ***F04D 29/046*** | (2006.01) |
| ***F04D 13/02*** | (2006.01) |
| ***F04D 15/00*** | (2006.01) |

(52) U.S. Cl.

CPC ..... *F04D 15/0088* (2013.01); *F04D 29/043* (2013.01); *F04D 29/046* (2013.01); *F05B 2240/54* (2013.01)

(58) Field of Classification Search

CPC .. F04D 29/046; F04D 15/0088; F04D 29/043; F05B 2240/60; F05B 2240/54

See application file for complete search history.

(56) References Cited

U.S. PATENT DOCUMENTS 5,265,773 A * 11/1993 Harada ..... B01F 7/00208 222/241
5,353,646 A * 10/1994 Kolpak ..... G01F 1/74 73/861.04
5,591,925 A 1/1997 Garshelis
5,723,794 A * 3/1998 Discenzo ..... G01L 1/241 73/800
6,122,977 A 9/2000 Soederholm et al.

(Continued)

FOREIGN PATENT DOCUMENTS

CN 201521430 U * 7/2010
WO WO-2013086822 A1 * 6/2013 ..... F04B 51/00

OTHER PUBLICATIONS

English translation of CN-201521430 (Year: 2010).*

(Continued)

*Primary Examiner* — Dominick L Plakkoottam
(74) *Attorney, Agent, or Firm* — Crowe & Dunlevy, P C.

(57) ABSTRACT

A test skid for a pumping system is configured to evaluate the performance of a pump. The test skid includes a motor and a torque-thrust chamber connected between the motor and the pump. The torque-thrust chamber has a torque meter and a thrust bearing. The thrust bearing is positioned between the torque meter and the motor such that the torque meter is connected directly to the pump through a pump input shaft. In this configuration, the torque meter measures the torque applied directly to the pump without the need to account for losses through an intermediate thrust bearing.

20 Claims, 3 Drawing Sheets

(56) References Cited

U.S. PATENT DOCUMENTS

| | | | | |
|---|---|---|---|---|
| 6,260,004 | B1 * | 7/2001 | Hays | F04D 15/0088 702/183 |
| 8,246,251 | B1 * | 8/2012 | Gardner | F04D 29/606 384/420 |
| 9,714,568 | B2 * | 7/2017 | Rendusara | E21B 43/128 |
| 2003/0172747 | A1 * | 9/2003 | Gandrud | G01L 3/102 73/862.323 |
| 2008/0315810 | A1 | 12/2008 | Akita | |
| 2011/0017013 | A1 | 1/2011 | Bader | |
| 2012/0257989 | A1 * | 10/2012 | Durham | F04B 51/00 417/63 |
| 2013/0181085 | A1 * | 7/2013 | Turley | B65H 19/2276 242/520 |
| 2013/0272898 | A1 * | 10/2013 | Toh | F04D 13/10 417/44.1 |
| 2018/0231058 | A1 * | 8/2018 | Nelson | F04D 29/0413 |

OTHER PUBLICATIONS

Kaydon, Bearing load scenarios, Apr. 20, 2013 (https://web.archive.org/web/20130420112130/https://www.kaydonbearings.com/typesACX.htm) (Year: 2013).*

Search Report and Written Opinion; PCT/US2019/051134; dated Nov. 21, 2019.

* cited by examiner

TORQUE-THRUST CHAMBER FOR HORIZONTAL PUMP TEST SYSTEMS

RELATED APPLICATIONS

The present application claims the benefit of U.S. Provisional Patent Application Ser. No. 62/733,196 filed Sep. 19, 2018, entitled, "Torque-Thrust Chamber for Horizontal Pump Test Systems," the disclosure of which is herein incorporated by reference.

FIELD OF THE INVENTION

This invention relates generally to the field of horizontal pumping systems, and more particularly to an improved system for evaluating torque within the pumping system.

BACKGROUND

Pumping systems are used in various industries for a wide range of purposes. For example, in the oil and gas industry horizontal pumping systems are used to pump fluids, such as separated water to storage tanks or disposal wells. Submersible pumping systems are used to recover water and petroleum products from subterranean reservoirs. Typically, these pumping systems include a pump, a motor, and a thrust bearing between the motor and the pump.

In designing and manufacturing pumping systems for these markets, it is important to accurately determine the performance parameters for each specific pump. Although pump curves can be mathematically estimated using known factors for the motor, pump and fluids, it is nonetheless useful to conduct performance tests on the actual pumping systems. These tests often include evaluating the performance of the pump and motor over a wide range of operating conditions. During these tests, it is useful to monitor the torque transferred from the motor to the pump through a series of interconnected shafts.

A standard prior art horizontal pump test skid 200 is depicted in FIG. 1. The horizontal pump test skid 200 is attached to a test pump 202. The pump test skid 200 includes a drive motor 204, a thrust bearing chamber 206 and a rotary torque meter 208. The thrust bearing chamber 206 is connected between the test pump 202 and the torque meter 208 to isolate the standard rotary torque meter 208 from axial thrust produced by the test pump 202 during operation. The standard rotary torque meter 208 may include strain gauges or other sensors that can be damaged or compromised when exposed to axial thrust from the test pump 202. Flexible shaft couplings 210 further isolate the rotary torque meter 208 from vibrations along the driveline between the drive motor 204 and the test pump 202.

Although this general configuration has been widely adopted, it nonetheless presents several drawbacks. In particular, the thrust bearing chamber 206 includes frictional thrust bearings that resist the rotation of the drive shafts. This resistance varies with thrust load and increases the overall torque demands of the system, which complicates the specific analysis of the test pump 202. To estimate the torque applied to the test pump 202 with the rotary torque meter 208, the losses through the intermediate thrust bearing chamber 206 must be subtracted from the total torque measured by the rotary torque meter 208. This indirect approach introduces several potential sources of inaccuracy and may frustrate efforts to properly evaluate the performance of the test pump 202. There is, therefore, a continued need for an improved pump test system that overcomes these and deficiencies in the prior art.

SUMMARY OF THE INVENTION

In one aspect, the present invention includes a test skid for a pumping system that is configured to evaluate the performance of a pump. The test skid includes a motor and a torque-thrust chamber connected between the motor and the pump. The torque-thrust chamber has a torque meter and a thrust bearing. The thrust bearing is positioned between the torque meter and the motor. A pump input shaft is connected between the torque meter and the pump.

In another aspect, the present invention includes a pumping system that has a motor, a pump driven by the motor, and a torque-thrust chamber connected between the motor and the pump. The torque-thrust chamber has a non-contact torque meter and a thrust bearing. The thrust bearing is positioned between the torque meter and the motor.

In yet another aspect, the present invention includes a torque-thrust chamber for use in a pump system that has a motor configured to drive a pump undergoing testing. The torque-thrust chamber includes a non-contact torque meter and thrust bearing. The thrust bearing is positioned between the torque meter and the motor.

WRITTEN DESCRIPTION

Figure 1:
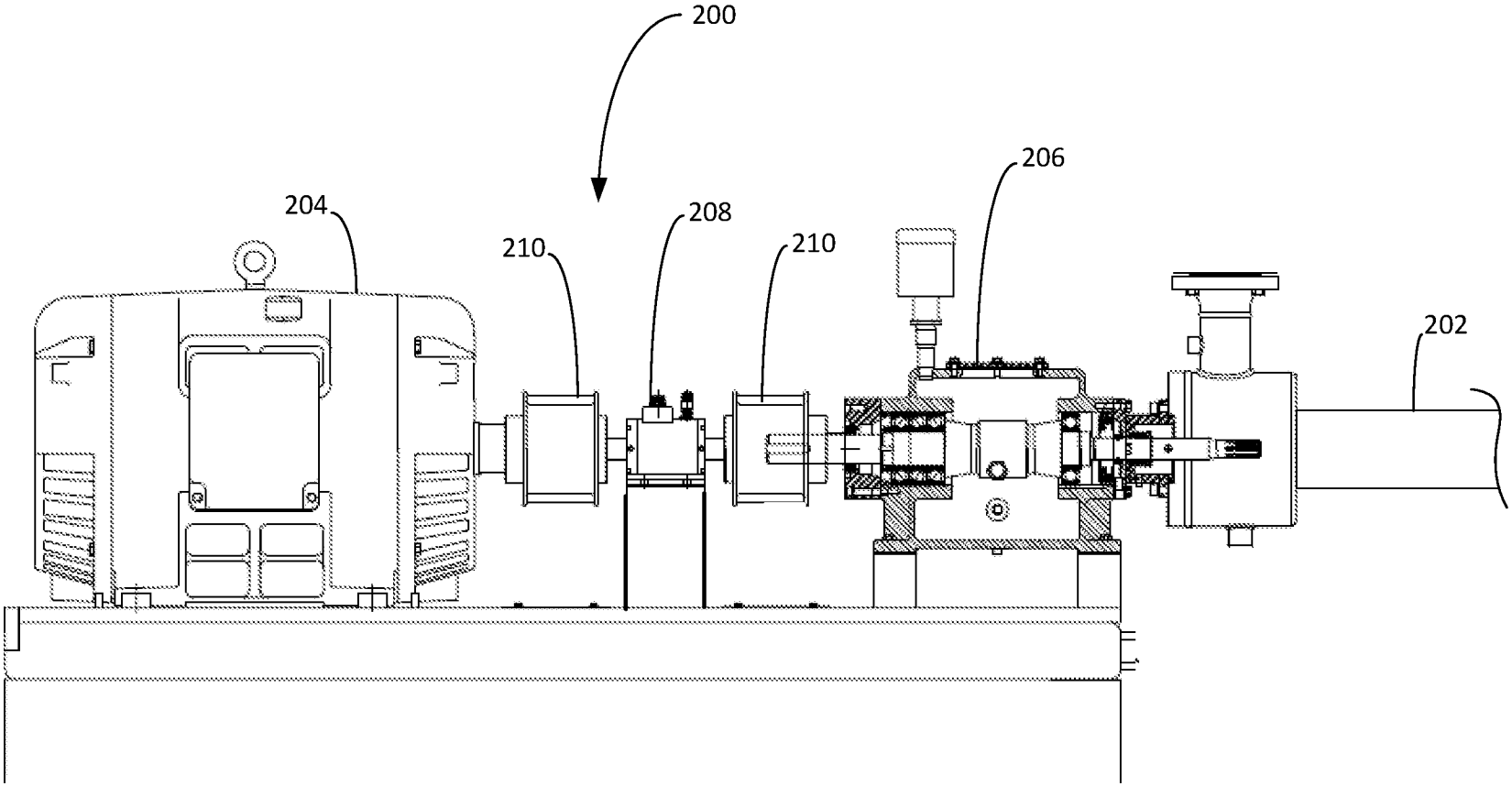
FIG. 1 PRIOR ART
FIG. 1 is a cross-sectional depiction of a PRIOR ART pump test skid.
Figure 2:
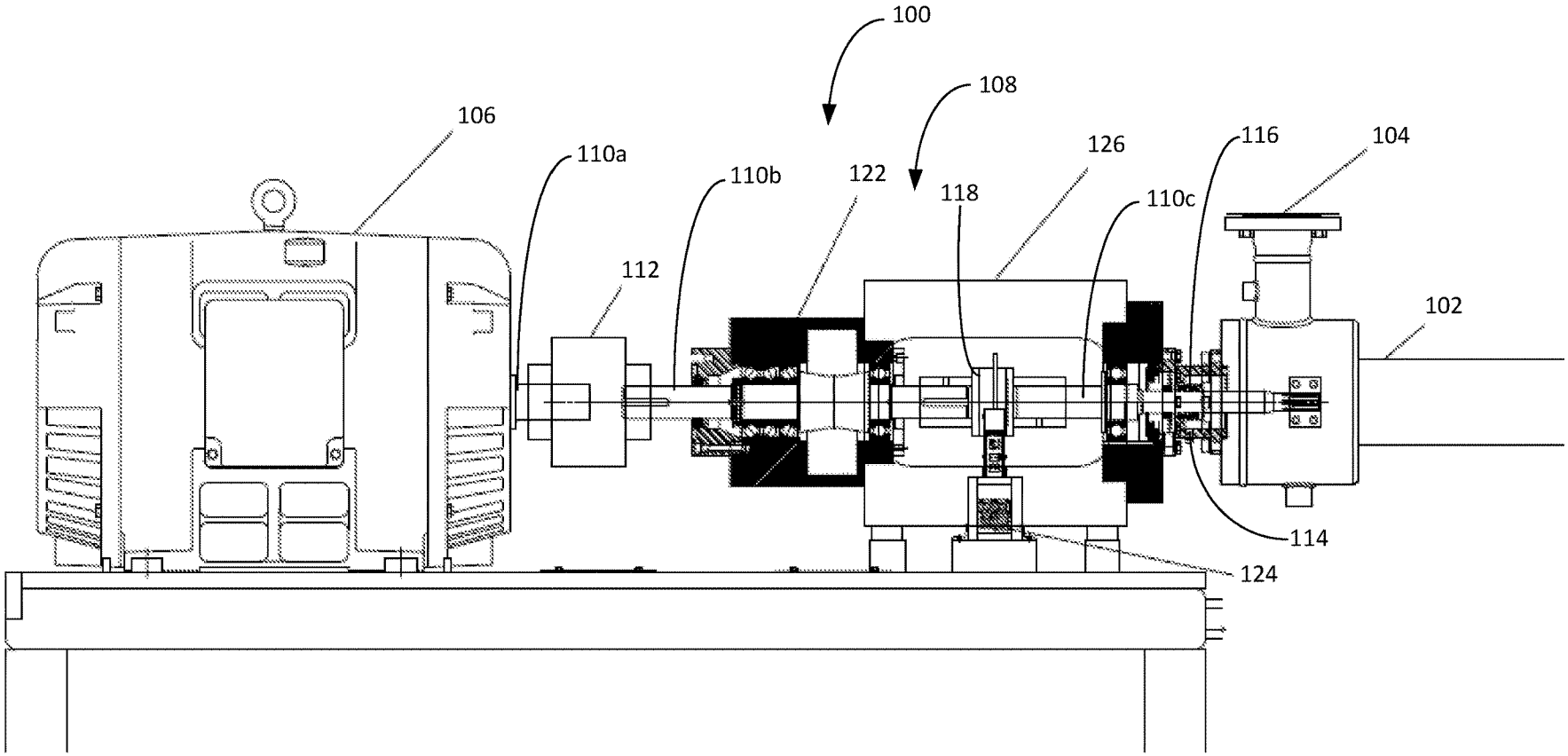
FIG. 2 is a depiction of a pump test skid constructed in accordance with an exemplary embodiment.

FIG. 2 depicts a test skid 100 constructed in accordance with an exemplary embodiment of the present invention. The test skid 100 is connected to a pump 102 for testing. Although the pump 102 is depicted as a horizontal, multistage centrifugal pump that is well suited for surface-based pumping operations, it will be appreciated that the pump 102 may also be designed for use in downhole applications in which the pump 102 is positioned in a vertical or deviated orientation. The test skid 100 includes a suction chamber 104 that provides a source of fluid to the pump 102, a motor 106 and a torque-thrust chamber 108 positioned between the pump 102 and the motor 106.

A series of interconnected shafts 110 carries torque from the motor 106 to the pump 102 through the torque-thrust chamber 108 and suction chamber 104. The shafts 110 may include a drive shaft 110*a*, a thrust bearing shaft 110*b* and a pump input shaft 110*c*. The test skid 100 may include a flexible coupling 112 to reduce vibrations carried along the driveshaft 110*a* and thrust bearing shaft 110*b*. The test skid 100 may include a suction chamber adapter 114 between the suction chamber 104 and the torque-thrust chamber 108. The suction chamber adapter 114 includes one or more shaft seals 116 that prevent fluids from entering the torque-thrust chamber 108 from the suction chamber 104 along the pump input shaft 110*c*.

Figure 3:
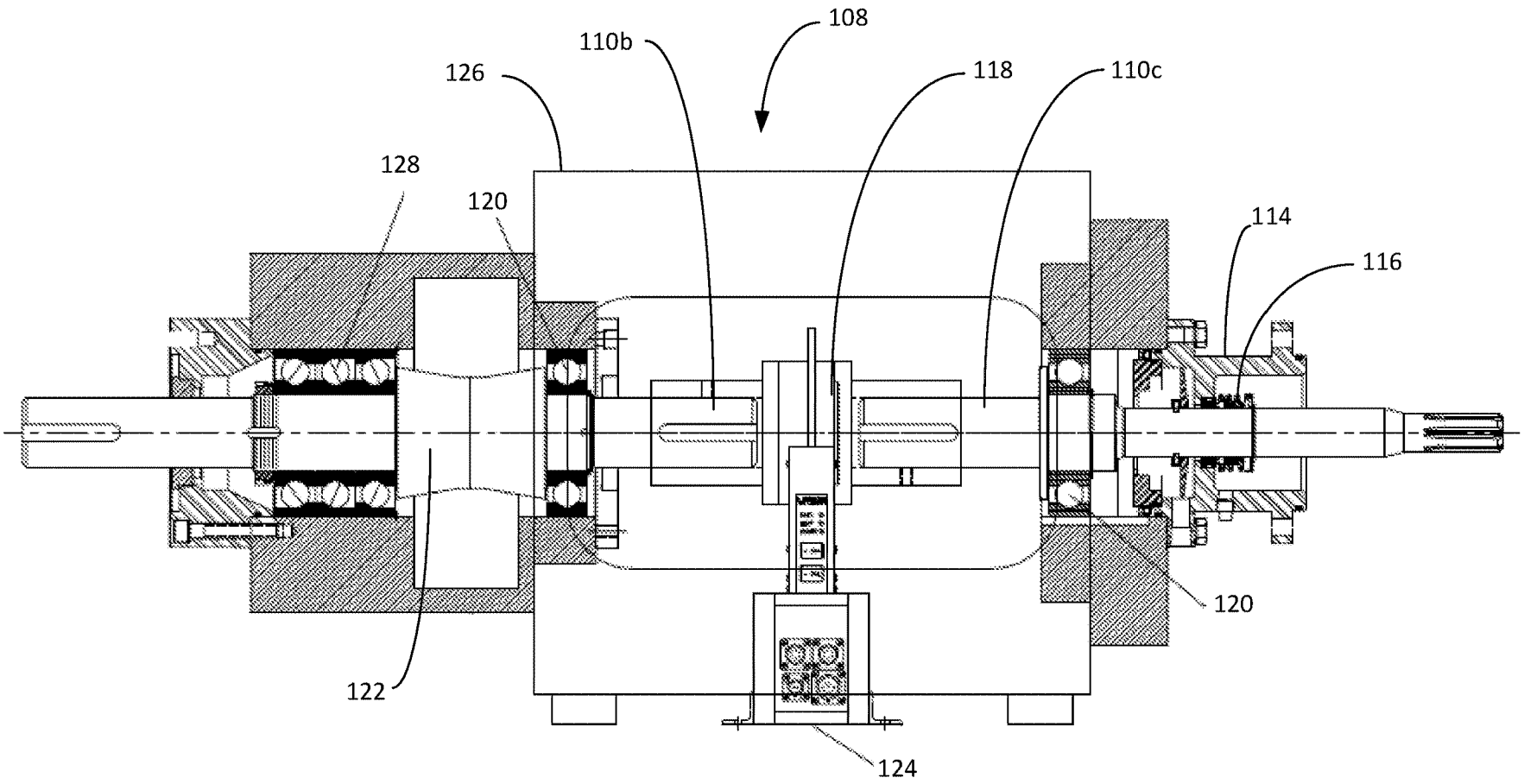
FIG. 3 is a depiction of the torque-thrust chamber of the pump test skid of FIG. 2.

The torque-thrust chamber 108 is depicted in greater detail in FIG. 3. As shown in FIG. 3, the torque-thrust chamber 108 includes a central housing 126, a torque meter 118, one or more radial bearings 120 and a thrust bearing 122. The thrust bearing 122 includes a plurality of angular contact bearings 128 that are configured to offset axial thrust carried along the thrust bearing shaft 110*b*. In other embodiments, the thrust bearing 122 may include a stationary thrust pad and a thrust runner in addition to, or as an alternative to, the angular contact bearings 128.

The radial bearings 120 provide support to the thrust bearing shaft 110*b* and pump input shaft 110*c*. In exemplary embodiments, the radial bearings 120 are permitted a degree of axial deflection, or float, so that they continue to support the shafts 110 in the event the shafts 110 are axially displaced during a thrust event. In this way, the radial bearings 120 are not exposed to thrust along the shafts 110.

The torque meter 118 is connected between the thrust bearing shaft 110*b* and the pump input shaft 110*c*. The torque meter 118 measures the torque applied to the pump 102. In exemplary embodiments, the torque meter 118 is a bearingless torque meter that is substantially immune to axially-directed thrust events. The torque meter 118 can measure torque carried through the pump input shaft 110*c* through non-contact mechanisms, such as magnetoelastic and optical measurement techniques. Suitable torque meters are available from S. Himmelstein and Company under the "MCRT" brand of high capacity, bearingless torque meters. The torque meter 118 may include an output panel 124 to present the torque measurements to motor drives and other control and testing equipment.

Because the torque meter 118 is not mechanically coupled to the thrust bearing shaft 110*b* and the pump input shaft 110*c*, it is not necessary to place a thrust bearing between the pump 108 and the torque meter 118 to shield the torque meter 118 from thrust produced by the pump 108. Instead, the thrust bearing 122 can be positioned between the torque meter 118 and the motor 106. In this position, any torque losses attributable to the thrust bearing 122 are not measured by the torque meter 118. This allows the torque meter 118 to more directly and specifically measure the torque applied to the pump 102 through the pump input shaft 110*c*.

Although the torque-thrust chamber 108 has been disclosed in connection with the test skid 100, it will be appreciated that the torque-thrust chamber 108 can also be deployed in production equipment. For example, it may be helpful in some applications to incorporate the torque-thrust chamber 108 in connection with a pump 102 deployed in the field. In a live production environment, the torque-thrust chamber 108 can provide valuable performance and equipment health information to the operator. In some embodiments, the torque-thrust chamber 108 is used to provide inputs to an automated motor control system that is configured to automatically adjust the operation of the motor 106 in response to torque measurements made by the torque-thrust chamber 108.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A test skid for a pumping system that includes a pump, the test skid comprising:
- a motor; and
- a torque-thrust chamber connected between the motor and the pump, wherein the torque-thrust chamber comprises:
  - a torque meter;
  - a thrust bearing, wherein the thrust bearing is positioned between the torque meter and the motor; and
  - a pump input shaft connected between the torque meter and the pump, wherein there are no thrust bearings between the torque meter and the pump.

2. The test skid of claim 1, wherein the torque meter is a non-contact torque meter.

3. The test skid of claim 2, wherein the torque meter is a bearingless digital torque meter.

4. The test skid of claim 1, further comprising:
- a flexible coupling;
- a drive shaft connected between the flexible coupling and the motor; and
- a thrust bearing shaft connected between the flexible coupling and the torque meter.

5. The test skid of claim 4, wherein the thrust bearing is connected to the thrust bearing shaft.

6. The test skid of claim 4, further comprising a suction chamber adapter connected between the pump and the torque-thrust chamber.

7. The test skid of claim 1, wherein the torque-thrust chamber further comprises one or more radial bearings.

8. A horizontal pumping system comprising:
- a motor;
- a pump driven by the motor; and
- a torque-thrust chamber connected between the motor and the pump, wherein the torque-thrust chamber comprises:
  - a non-contact torque meter; and
  - a thrust bearing, wherein the thrust bearing is positioned between the torque meter and the motor and wherein there are no thrust bearings between the torque meter and the pump.

9. The horizontal pumping system of claim 8, wherein the torque meter is a bearingless torque meter that provides a torque output signal representative of the torque applied to the pump.

10. The horizontal pumping system of claim 9, further comprising a motor drive and wherein the torque output signal is provided to the motor drive to adjust the operation of the motor.

11. The horizontal pumping system of claim 8, further comprising:
- a flexible coupling;
- a drive shaft connected between the flexible coupling and the motor; and
- a thrust bearing shaft connected between the flexible coupling and the torque meter.

12. The horizontal pumping system of claim 11, wherein the thrust bearing is connected to the thrust bearing shaft.

13. The horizontal pumping system of claim 12, further comprising a pump input shaft connected between the torque meter and the pump.

14. The horizontal pumping system of claim 13, wherein the torque-thrust chamber further comprises a plurality of radial bearings that support the pump input shaft and thrust bearing shaft.

15. The horizontal pumping system of claim 8, further comprising a suction chamber adapter connected between the pump and the torque-thrust chamber.

16. A torque-thrust chamber for use in a pump test system that has a motor configured to drive a pump undergoing testing, the torque-thrust chamber comprising:

a non-contact torque meter; and thrust bearing selected from the group consisting of angular contact bearings and a stationary thrust pad with a thrust runner, wherein the thrust bearing is positioned between the torque meter and the motor and wherein there are no thrust bearings between the torque meter and the pump.

17. The torque-thrust chamber of claim 16, wherein the torque meter is a bearingless torque meter that provides a torque output signal representative of the torque applied to the pump.

18. The torque-thrust chamber of claim 17, wherein the torque output signal is provided to a motor drive to adjust the operation of the motor.

19. The torque-thrust chamber of claim 16, wherein the non-contact torque meter determines torque through an optical measurement mechanism.

20. The torque-thrust chamber of claim 16, wherein the non-contact torque meter determines torque through a magneto-elastic measurement mechanism.

* * * * *